United States Patent [19]

Tyler et al.

[11] Patent Number: 5,015,439

[45] Date of Patent: May 14, 1991

[54] EXTRUSION OF METALS

[75] Inventors: Derek E. Tyler, Cheshire; Sankaranarayanan Ashok, Bethany; Harvey P. Cheskis, North Haven, all of Conn.

[73] Assignee: Olin Corporation, Cheshire, Conn.

[21] Appl. No.: 459,884

[22] Filed: Jan. 2, 1990

[51] Int. Cl.[5] ..... B22F 1/00

[52] U.S. Cl. ..... 419/23; 264/6; 419/33; 419/67

[58] Field of Search ..... 264/6; 419/23, 33, 67

[56] References Cited

U.S. PATENT DOCUMENTS

| | | | |
|---|---|---|---|
| 3,765,216 | 10/1973 | Green | 72/262 |
| 3,872,703 | 3/1975 | Green | 72/262 |
| 4,362,485 | 12/1982 | Slater et al. | 425/79 |
| 4,378,686 | 4/1983 | Pardoe | 72/262 |
| 4,397,622 | 8/1983 | Childs et al. | 419/67 |
| 4,419,324 | 12/1983 | Childs et al. | 419/67 |
| 4,468,945 | 9/1984 | Fairey | 72/262 |
| 4,505,878 | 3/1985 | Childs et al. | 419/67 |
| 4,557,894 | 12/1985 | Bangay et al. | 419/67 |
| 4,564,347 | 1/1986 | Vaughan | 425/79 |
| 4,566,303 | 1/1986 | McKenna | 72/262 |
| 4,601,325 | 7/1986 | Maddock | 164/476 |

OTHER PUBLICATIONS

Continuous Extrusion Conform . . . by Holton; Castex--Aluminum Molten Metal Feed.

"Recent Developments in Conform and Castex Continous Extrusion Technology", by Dr. J. Langerweger and B. Maddock, Light Metal Age, Aug. 1988, pp. 23-24 and pp. 26-28.

"Continuous Extrusion Conform . . . by Holten, Single Wheel Extruders".

The Manufacture of aluminum Shapes for Electrical Cables and Other Products by the Conform Extrusion Process, by B. Maddock.

Continuous Extrusion; Complete Conform-Castex Technology for Aluminum and Copper, by Holton.

*Primary Examiner*—Stephen J. Lechert, Jr.

*Attorney, Agent, or Firm*—H. Samuel Kieser

[57] ABSTRACT

A metal extrusion process and apparatus in wich a semisolid material is fed into a passageway formed between first and second members, with one of the members being moved toward a die such that the moveable member draws the semisolid material through the passageway and through the die means.

7 Claims, 1 Drawing Sheet

EXTRUSION OF METALS

This invention relates to the forming of metal shapes by extrusion and more particularly to an improved method and apparatus for the continuous extrusion of metal.

A process and apparatus for continuous extrusion is described in U.S. Pat. No. 3,765,216. This process is now known in the metal fabricating industry as the Conform Process. This process comprises the steps of feeding metal into one end of a passageway formed between first and second members, with the second member having a greater surface area for engaging the material than the first member. The passageway is blocked at one end, remote from the feeding end, and has at least one die orifice associated with the blocked end. The moving of the passageway-defining surface of the second member relative to the passage-defining surface of the first member in a direction towards the die orifice from the first end to the blocked end is such that the frictional drag of the passageway-defining surface of the second member draws the material through the passageway and generates in it a pressure that is sufficient to extrude it through the die orifice.

In the usual application of the Conform Process, the passageway is arcuate with the second member comprising a wheel with a groove formed in the surface into which the first member projects. The blocked end of the passageway is defined by an abutment projecting from the first member into the groove.

The Conform Extrusion Process is more fully explained in the pamphlets of Holten Machinery Ltd. entitled "Continuous Extrusion Conformed by Holten Single Wheel Extruders"and "Manufacture of Shapes for Electrical Cables and Other Products by the Conform Extrusion Process".

Other patents relating to this type of extrusion process include U.S. Pat. Nos. 3,872,703, 4,362,485, 4,378,686, 4,397,622, 4,419,324, 4,468,945, 4,505,878, 4,564,347, 4,557,894, and 4,566,303.

The Conform Process is specifically adapted for the feeding of a solid rod or metal powder into the passageways of the apparatus for extrusion into rod-like shapes. A modification to such process has been made in which molten metal is used as the starting material. This type of process, known as the Castex Process, is more fully described in U.S. Pat. No. 4,601,325. According to that patent, a wheel is provided having an endless peripheral groove therein which is rotated about a horizontal axis and a fixed structure which cooperates with the wheel to cover the groove along a part of its length to form a passageway in which is provided with a die orifice leading from the closed off passageway. According to that process, molten metal is fed into the passageway and cooling is provided so that the molten metal is solidified before it is forced through the die orifice.

The Conform and Castex processes are further described in Holten Machinery Ltd. pamphlets entitled "Continuous Extrusion Complete Conform-Castex Technology for Aluminum and Copper", and "Continuous Extrusion Conform . . . by Holten, Castex-Aluminum Molten Metal Feed". Additionally, an article entitled "Recent Developments in Conform and Castex Continuous Extrusion Technology" by Langowerger and Maddock appearing in *Light Metal Age*, August 1988, pages 23–28, also provides a description of the two processes.

Both the Conform and Castex processes have, in general, been limited to the production of rod-like shapes from either rod or granules of various sizes or, in the case the Castex process, from a starting material in molten form.

In the case of copper, copper alloys, and other higher melting materials, the width of the product which can be produced is somewhat limited by the present Conform Process utilizing rods, granules, or powder. In an attempt to make relatively larger or wider products, the present Conform machine requires an expansion chamber to allow the narrow incoming stock to be expanded before being extruded through the die. The geometry of the expansion chamber requires that the side walls flare out gradually rather than abruptly. This geometric requirement places the exit die relatively far away from the point of entry of the consolidated material and results in extrusion forces which are beyond practical limits. Additionally, at the extrusion temperatures required, the loads develoPed on the abutment member or blocking member are higher than the yield strength of the conventional steel tools used for copper alloys and other higher melting materials.

The Castex Process involves the feeding of liquid metal directly onto the extrusion wheel. For low melting materials, such feeding is feasible. However, the temperature rise in the wheel and the other parts of the extruder precludes most high temperature materials from being produced in this matter.

Accordingly, it is the object of the present invention to provide an improved method and operation for extruding metal.

More specifically, it is another object of the present invention to Provide an improved method by continuously extruding metal which overcomes the problem mentioned above.

It is yet another object of the present invention to provide an improved method and apparatus for continuously extruding metal in which the force required to extrude the metal is reduced with respect to the prior art friction drag type process.

These and other objects and advantages of the present invention may be accomplished through the provision of a process for extruding metal which utilizes an apparatus including a passageway formed between a first member and a second member. The passageway has an opening for the reception of the material to be extruded and a closed end remote from said opening and die means adjacent to said closed end. The process comprises continuously introducing a semisolid metal into the open end of the passageway and moving said first member relative to said second member in a direction toward said die means from said open end to said closed end so that the metal in its semisolid condition is drawn through the passageway and through the die means.

An apparatus for practicing the process, according to the present invention, includes first and second members defining an elongated passageway therebetween, with the passageway having an opening at one end thereof. Means are provided which block the passageway at the other end thereof and an orifice extends from such passageway adjacent to blocked end. Die means are provided in communication with the orifice and means are provided for moving said first member relative to said second member in the direction of the length of the passageway. Means are provided for introducing a semisolid metal into the passageway at the open end thereof, whereby the semisolid metal is drawn through the passageway upon movement of the first member relative to the second member and through the die means.

The present invention may be more readily understood by reference to the following detailed description and to the accompanying drawings in which.

Figure 1:
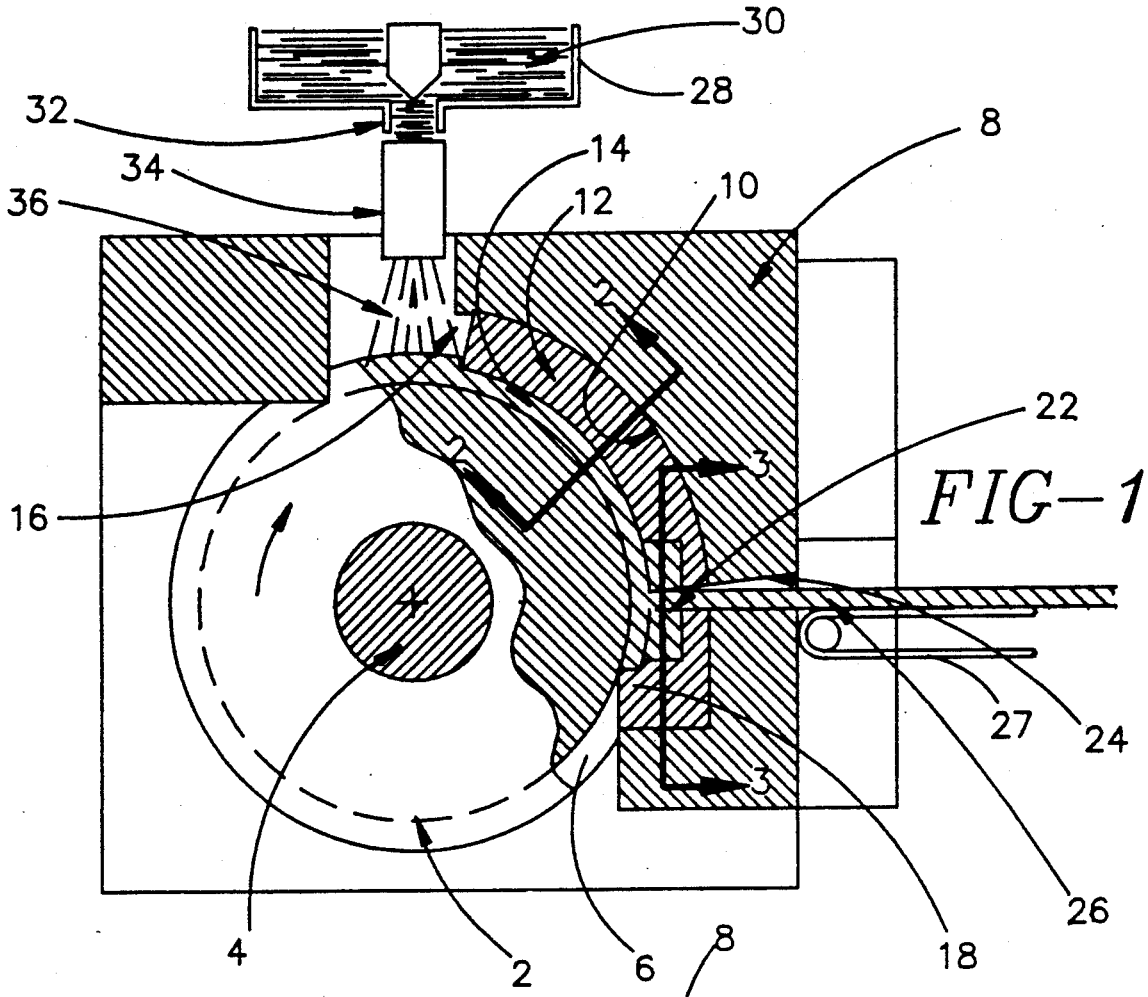
FIG. 1 is an elevation view, partly in section of an extrusion apparatus for use in practicing the present invention.
Figure 2:
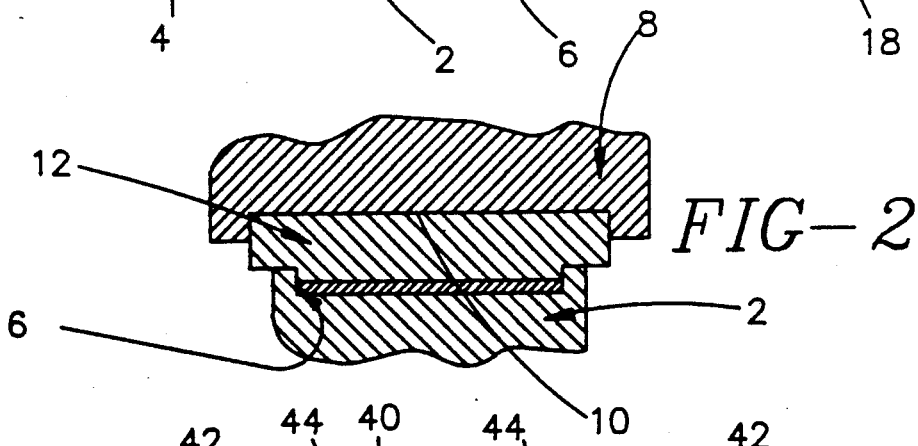
FIG. 2 is a section of a view taken along the lines 2—2 of FIG. 1.

Referring now to the drawings, the extrusion apparatus shown therein comprises a first member in the form of a wheel 2 rotatively mounted on a shaft 4. The wheel 2 is formed with a continuous peripheral groove 6 which may have a rectangular cross section. A second member, in the form a shoe 8 extends about a portion of the periphery of the wheel 2 and includes a groove 10 in which is mounted a removable abutment or insert member 12.

The insert member 12 projects into the groove 6 in the wheel 2, forming a passageway 14, and includes an open-end portion 16 and a closed end portion, formed by an abutment portion 18. The abutment portion 18 is positioned at the end of the passageway 14 opposite the open-end portion 16 and extends into and substantially blocks the groove 6 and hence the passageway 14 formed between the wheel 2 and the shoe 8. Alternatively, the abutment portion 18 may be formed as a member separate from the insert 12. Suitable means, not shown, may be provided for releasably securing the insert or abutment member 12 within the shoe 8 and also for readily adjusting the position of the insert member 12 within the groove 6 in the wheel 2 to define the thickness of the Passageway 14 formed between the wheel 2 and the insert 12.

A die member 20 is provided adjacent to the closed end portion 18 of the passageway 14 and is in communication therewith. Preferably, the die member 20 is mounted in the insert member 12 and has an opening 22 therethrough which communicates directly with the passageway 14. The die member 20 may be formed in one or more pieces depending upon the configuration of its opening. A suitable opening 24 is provided in the insert member 12 and the shoe 8 on the opposite side of the die member 20 from the passageway 14 to permit the exit of the extruded material 26 from the apparatus. An endless substrate 27 may be provided to receive the extruded material 26 and provide support therefore as it leaves the apparatus.

When high temperature materials are used, the tooling of the apparatus, including the wheel 2 and insert 12 including the abutment portion 18, may be fabricated from a high strength heat-resistant material which is capable of withstanding the high temperatures and extrusion pressures. Such material includes high strength ceramic materials such as aluminum nitride and silicon carbide.

In accordance with the present invention, the metal to be extruded is in semisolid form. One way of producing such semisolid material is by atomization to produce particles or droplets of semisolid material. As shown schematically in FIG. 1, a tundish 28 may be provided which receives the molten metal 30 from a tillable melt furnace (not shown) by a transfer launder (not shown) and has a bottom nozzle 32 through which the molten metal issues in a stream downwardly from the tundish 28.

A suitable atomizing device 34 is positioned below the tundish bottom nozzle 32 for atomizing the molten metal spray 36 of molten metal particles which broadcasts downwardly from the atomizing device 34 onto the surface of the groove 6 in the wheel 2.

The atomization of the molten metal stream may be accomplished in a number of ways. One such way is by centrifugal atomization which utilizes centrifugal force to break up the liquid stream into the particles. Such method is described in the article "Atomization" published in the Metals Handbook, 9th Edition, Vol. 7, Powder Metallurgy, American Society for Metals, Metal Park, Ohio. Another method of atomization involves the use of electromagnetic energy to break up the liquid stream. This process of atomization is more fully described in an article entitled "Development of Electromagnetic Atomization Process" by K. Sassa, T. Kozuka and S. Asai appearing in "Metallurgical Processes for the Year 2000 and Beyond", pp 59–67, The Minerals, Metals & Materials Society, 1988. Additionally, mechanical means may be used to rapidly stir or swirl the molten stream to break it up into the particles.

The atomized particles of liquid metal droplets partially solidify as they fall and impinge upon the surface of the groove 6 in the wheel 2 where they form into a semisolid layer with liquid present in the interstices, between splatted droplets. This semisolid condition is maintained throughout the extrusion process up until the point the material has issued from the die. By semisolid is meant that the solid content comprises from about 10% to about 90% of the metal with the remainder being liquid during the extrusion process.

With the provision of a semisolid material to the wheel 2 of the extrusion apparatus, a substantial portion of the latent heat of fusion of the metal is removed prior to contact with the wheel. Accordingly, the temperature rise in the wheel 2 will be significantly less than that with the prior Castex Process utilizing molten metal. This permits the production of high temperature alloys. Additionally, since the heat to be extracted by the wheel is reduced because of the partial solidification, the wheel diameter may be reduced and production rate increased as compared to present processes. Also, since the material is semisolid, the loads throughout the apparatus will be significantly less, permitting more complicated and larger shapes to be made.

The process particularly lends itself to making strip material of intricate shaPe. Accordingly, the groove shown in the wheel 2, along with the insert 12, forms a generally rectangular cross sectional passageway which has a relatively large width with respect to its height. By way of example, the width of the material may be over 2 inches while the height or thickness of the strip may be 0.50 mil or less. Ideally the strip material has an overall height to width ratio of 0.50 or less.

Figure 3:
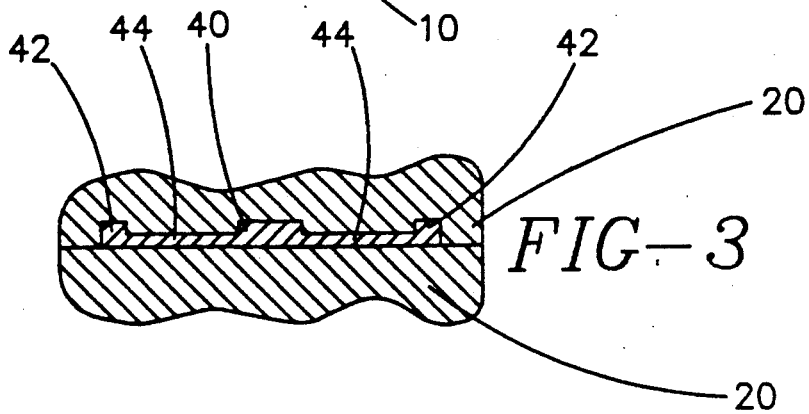
FIG. 3 is a partial section of a view taken along the lines 3—3 of FIG. 1.

The configuration of die member 20 may be such that the extruded strip material produced has a generally irregular cross section. For example, as shown in FIG. 3, the extruded product may comprise a central raised portion 40 and two raised end portions 42 with the material 44 intermediate to the central and end portions being of reduced cross section. Material of this shape fabricated from copper or copper alloys has use in electronic applications and a product of this shape may be subjected to rolling and the resultant strip cut to the approximate shape after extruding to produce terminal members, contact members, reeds, and lead frames.

As described above, with the process and apparatus of the present invention, it is possible to extrude metal alloys having relatively high yield strengths such as copper base alloys, and wider, thinner extrusions can be produced.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, Patents, and other publications cited herein are incorporated by reference in their entirety.

What is claimed is:

1. The process for extruding metal in an apparatus which includes a passageway formed between a first member and a second member, said passageway having an opening for the reception of a material to be extruded and a closed end remote from said opening, and die means adjacent said closed end, said process comprising:

a. continuously introducing a semisolid metal material into said opening of said passageway, b. moving said first member relative to said second member in a direction toward said die means from said open end to said closed end so that said metal is drawn through the passageway, and c. maintaining said material in its semisolid condition as it passes through said die means.

2. The process of claim 1 wherein said metal introduced is atomized from a stream of molten metal prior to entering said passageway.

3. The process of claim 1 wherein said semisolid material comprises from about 10% to about 90% solid, the remainder being liquid.

4. The process of claim 1 wherein said material is copper or a copper alloy.

5. The process of claim 1 wherein said die means has an opening having a substantially greater width than height.

6. The process of claim 1 wherein the opening to the die means has an overall height substantially less than the overall width.

7. The process of claim 4 wherein the ratio of the overall height to the overall width of the opening in said die means is 0.10 or less.

* * * * *